US007669449B1

(12) United States Patent
Sundstrom et al.

(10) Patent No.: US 7,669,449 B1
(45) Date of Patent: Mar. 2, 2010

(54) LOW INTENSITY SHOT PEENING

(75) Inventors: Wilfred A. Sundstrom, Snohomish, WA (US); Brian K. Kopp, Arlington, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/185,968

(22) Filed: Aug. 5, 2008

(51) Int. Cl.
*B24C 7/00* (2006.01)
*C21D 7/06* (2006.01)
*B05B 5/00* (2006.01)

(52) U.S. Cl. ..... 72/53; 29/90.7; 239/690.1; 451/38

(58) Field of Classification Search ..... 72/53; 239/690.1, 692, 698; 451/38–40; 29/90.7
See application file for complete search history.

(56) References Cited

U.S. PATENT DOCUMENTS 3,419,894 A * 12/1968 Burney et al. ..... 72/53
3,624,967 A 12/1971 Kamper et al.
4,365,493 A * 12/1982 Feld et al. ..... 72/53
4,706,356 A * 11/1987 Bianchi et al. ..... 29/90.7
5,048,316 A * 9/1991 Thompson ..... 72/21.4
5,230,185 A 7/1993 Kirschner et al.
5,460,025 A 10/1995 Champaigne
5,596,912 A * 1/1997 Laurence et al. ..... 72/53
5,622,313 A * 4/1997 Lader et al. ..... 239/692
5,850,976 A * 12/1998 Robidoux ..... 239/698
6,247,657 B1 * 6/2001 Finney et al. ..... 239/690.1
6,464,570 B1 * 10/2002 Shaw et al. ..... 451/38
6,516,645 B2 * 2/2003 Morales et al. ..... 72/53
6,519,991 B2 * 2/2003 Hirano et al. ..... 72/53
7,140,216 B2 * 11/2006 Garza ..... 72/53

OTHER PUBLICATIONS

Niku-Lari, "Shot-Peening", 1981, pp. 1-21 http://www.shotpeener.com/library/pdf/1981061.pdf.
Nakonieczny, "Effect of Shot Peening on Fatigue Life of Machine Elements", 1981, pp. 45-50 http://www.shotpeener.com/library/pdf/1981083.pdf.
Plaster, "Technical Aspects of Shot-Peening Machinery and Media", 1981, pp. 83-94 http://www.shotpeener.com/library/pdf/1981067.pdf.

* cited by examiner

*Primary Examiner*—David B Jones
(74) *Attorney, Agent, or Firm*—Yee & Associates, P.C.; Brett L. Halperin

(57) ABSTRACT

A method may be present for sending shot onto a surface. A stream of shot may be directed into an inlet of a nozzle. The stream of shot may be redirected to form a plurality of streams of shot within the nozzle. The plurality of streams of shot may be directed out of a plurality of outputs of the nozzle.

20 Claims, 6 Drawing Sheets

LOW INTENSITY SHOT PEENING

BACKGROUND INFORMATION

1. Field

The present disclosure relates generally to manufacturing and in particular to a method and apparatus for processing metal components. Still more particularly, the present disclosure relates to a method and apparatus for performing shot peening on of metal components.

2. Background

In manufacturing various components, it may be desirable to improve the properties of the material. One process that may be performed on a metal material may be peening. Peening may be a process of working a surface of a metal to change the properties of the metal. Typically, the change may be an improvement to the properties of the metal. Peening may be performed using a mechanical means such as, for example, without limitation, blows by a hammer, shot peening, and laser peening.

With shot peening, a surface of a metal material may be impacted with shot to produce a compressive residual stress layer and modify mechanical properties of the metal. The impact of the shot may occur with a force sufficient to create plastic deformation. This type of process may be performed using shot in the form of, for example, without limitation, round metal particles, glass particles, ceramic particles, or other suitable particles.

Shot peening a surface may cause changes in the mechanical properties and may be performed in manufacturing aircraft parts and aircraft repairs. Shot peening may be performed to relieve tensile stresses that may build up in various components and replace those stresses with beneficial compressive stresses. Shot peening may be performed on various surfaces of an aircraft part such as, for example, without limitation, a wing, a tail, a fuselage, or part thereof, or some other surface or portion of a surface of an aircraft.

Shot peening may be performed using booths and/or computer-controlled systems. This type of shot peening may be referred to as an automated shot peening operation. Manual shot peening also may be performed by operators and may be used when the particular aircraft part may be too large and/or irregular in shape to fit within a booth and/or to be processed by a computer-controlled system. Further, manual shot peening may be performed as a touch-up in addition to automated shot peening to process an area or portion of a surface that was not shot peened by a computer-controlled system.

Manually performing shot peening may be laborious and time-consuming. For example, when shot peening is performed on an edge of a wing skin, portable equipment for performing shot peening may be used in which a stream of shot may be directed towards the edge and/or other portion.

Currently, lower air pressures may be used to perform shot peening, such as, for example, without limitation, around 12 pounds per square inch to around 15 pounds per square inch. If the air pressure increases too much, the force at which the shot impacts the surface of the metal material may be greater than desired. With a lower amount of air pressure, the amount of shot media that can be introduced into the air stream is limited, and the time needed to perform shot peening is greater than with a higher air pressure.

Therefore, it would be advantageous to have a method and apparatus that overcomes the problems described above, as well as other problems.

SUMMARY

In one advantageous embodiment, a method may be present for sending shot onto a surface. A stream of shot may be directed into an inlet of a nozzle. The stream of shot may be redirected to form a plurality of streams of shot within the nozzle. The plurality of streams of shot may be directed out of a plurality of outputs of the nozzle.

In another advantageous embodiment, an apparatus may comprise a nozzle, a first inlet in the nozzle, a plurality of channels, a diverter, and a plurality of outputs. The first inlet in the nozzle may be capable of receiving a stream of shot. The plurality of channels may have a first end connected to the first inlet. The diverter may connect a first end of the plurality of channels to the first inlet. The plurality of outputs may be located at a second end of the plurality of channels.

In yet another advantageous embodiment, a method for shot peening may be present. A stream of shot may be directed into an inlet of a nozzle. The stream of shot may be directed into a first channel in an inlet of a nozzle. The stream of shot may be directed into a second channel in the inlet. The second channel may be smaller than the first channel. The stream of shot may be redirected to form a plurality of the streams of shot within the nozzle by dividing the stream of shot into the plurality of streams of shot with a diverter inside the nozzle. The plurality of streams of shot may be directed out of a plurality of outputs of the nozzle to around a location from different angles. The outputs of the nozzle may be pointed at a surface of a material, wherein the location may be located around the surface of the material.

In still yet another advantageous embodiment, a shot peening apparatus may comprise a nozzle, a first inlet in the nozzle, a plurality of channels, a diverter, a plurality of outputs, a pressure vessel, a hose, and an air unit. The first inlet in the nozzle may be capable of receiving a stream of shot. The inlet may comprise a first channel connected to a second channel. The first channel is larger than the second channel and the second channel leads to the diverter. The plurality of channels may have a first end connected to the first inlet. The plurality of channels may be capable of redirecting the stream of shot to form a plurality of streams of shot within the nozzle and wherein the plurality of channels have a cross section with a shape selected from one of a circle, a square, and a rectangle. The diverter may connect a first end of the plurality of channels to the first inlet. The plurality of outputs may be located at a second end of the plurality of channels. The plurality of outputs may be capable of directing the plurality of streams of shot to around a location from different angles. The pressure vessel may be capable of holding shot. The hose may connect the nozzle to the pressure vessel. The air unit may be capable of sending a stream of pressurized air through the pressure vessel to form the stream of shot.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
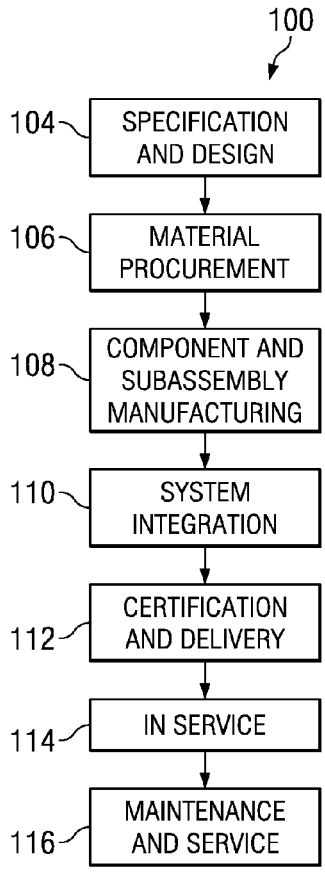
FIG. 1 is a flow diagram of an aircraft production and service methodology in accordance with an advantageous embodiment.
Figure 2:
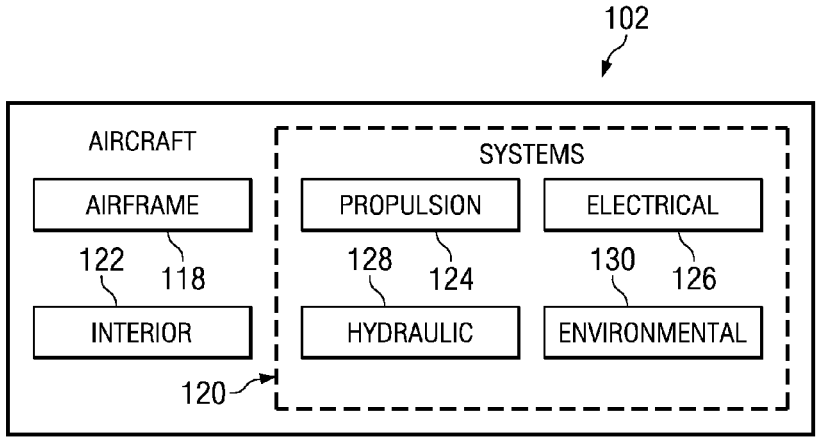
FIG. 2 is a block diagram of an aircraft in accordance with an advantageous embodiment.

Referring more particularly to the drawings, embodiments of the disclosure may be described in the context of aircraft manufacturing and service method 100 as shown in FIG. 1 and an aircraft 102 as shown in FIG. 2. During pre-production, aircraft manufacturing and service method 100 may include specification and design 104 of aircraft 102 and material procurement 106.

During production, component and subassembly manufacturing 108 and system integration 110 of aircraft 102 takes place. Thereafter, aircraft 102 may go through certification and delivery 112 in order to be placed in service 114. While in service by a customer, aircraft 102 may be scheduled for routine maintenance and service 116 (which may also include modification, reconfiguration, refurbishment, and so on).

Each of the processes of aircraft manufacturing and service method 100 may be performed or carried out by a system integrator, a third party, and/or an operator (e.g., a customer). For the purposes of this description, a system integrator may include, for example, without limitation, any number of aircraft manufacturers and major-system subcontractors; a third party may include, for example, without limitation, any number of venders, subcontractors, and suppliers; and an operator may be, for example, without limitation, an airline, leasing company, military entity, service organization, or other suitable entity.

As shown in FIG. 2, aircraft 102 produced by aircraft manufacturing and service method 100 may include airframe 118 with a plurality of systems 120 and interior 122. Examples of systems 120 include one or more of propulsion system 124, electrical system 126, hydraulic system 128, and environmental system 130. Any number of other systems may be included in this example. Although an aerospace example is shown, the principles of the disclosure may be applied to other industries, such as, for example, without limitation, the automotive industry.

Apparatus and methods embodied herein may be employed during any one or more of the stages of aircraft manufacturing and service method 100. For example, components or subassemblies corresponding to component and subassembly manufacturing 108 may be fabricated or manufactured in a manner similar to components or subassemblies produced while aircraft 102 is in service 114.

Also, one or more apparatus embodiments, method embodiments, or a combination thereof may be utilized during component and subassembly manufacturing 108 and system integration 110, for example, without limitation, by substantially expediting assembly of or reducing the cost of aircraft 102. Similarly, one or more of apparatus embodiments, method embodiments, or a combination thereof may be utilized while aircraft 102 is in service, for example, without limitation, to maintenance and service 116. For example, without limitation, shot peening in accordance with the advantageous embodiments may be performed during at least one of component and subassembly manufacturing 108 and/or maintenance and service 116.

The different advantageous embodiments recognize and take into account that selecting an air pressure to provide the appropriate force from the shot on a surface and the amount of shot that can be directed to the surface may result in the process taking more time than desired to complete. Even with an optimized air pressure for maximizing the shot through a currently available nozzle, the different advantageous embodiments take into account and recognize that a shot peening process performed manually by a person using currently available nozzles may still be cumbersome and time-consuming. The different advantageous embodiments recognize and take into account that currently available nozzles have only a single channel through which a single stream of shot may be directed onto a surface of a material for which shot peening is to be performed.

Thus, the different advantageous embodiments provide a method and apparatus for performing shot peening. A stream of shot may be directed into an inlet of a nozzle. The stream of shot may be redirected to form a plurality of streams of shot within the nozzle. The plurality of streams of shot may be directed out of a plurality of outputs for the nozzle. These streams of shot may be directed at a surface of a material to perform shot peening.

The streams from the outputs may be directed towards a location, such as, for example, a single point. This point may be the point at which the shot peening may occur. Further, the directing of the streams may be from different angles to around the same point. With this type of splitting and/or redirecting of the stream of shot, higher air pressures may be used to achieve the desired force on the surface as compared to currently available nozzles used for shot peening. With the higher air pressure, the streams of shot directed to the surface by the nozzle are capable of delivering more shot in the stream and capable of shot peening more surface area faster as compared to shot peening with currently available nozzles.

Figure 3:
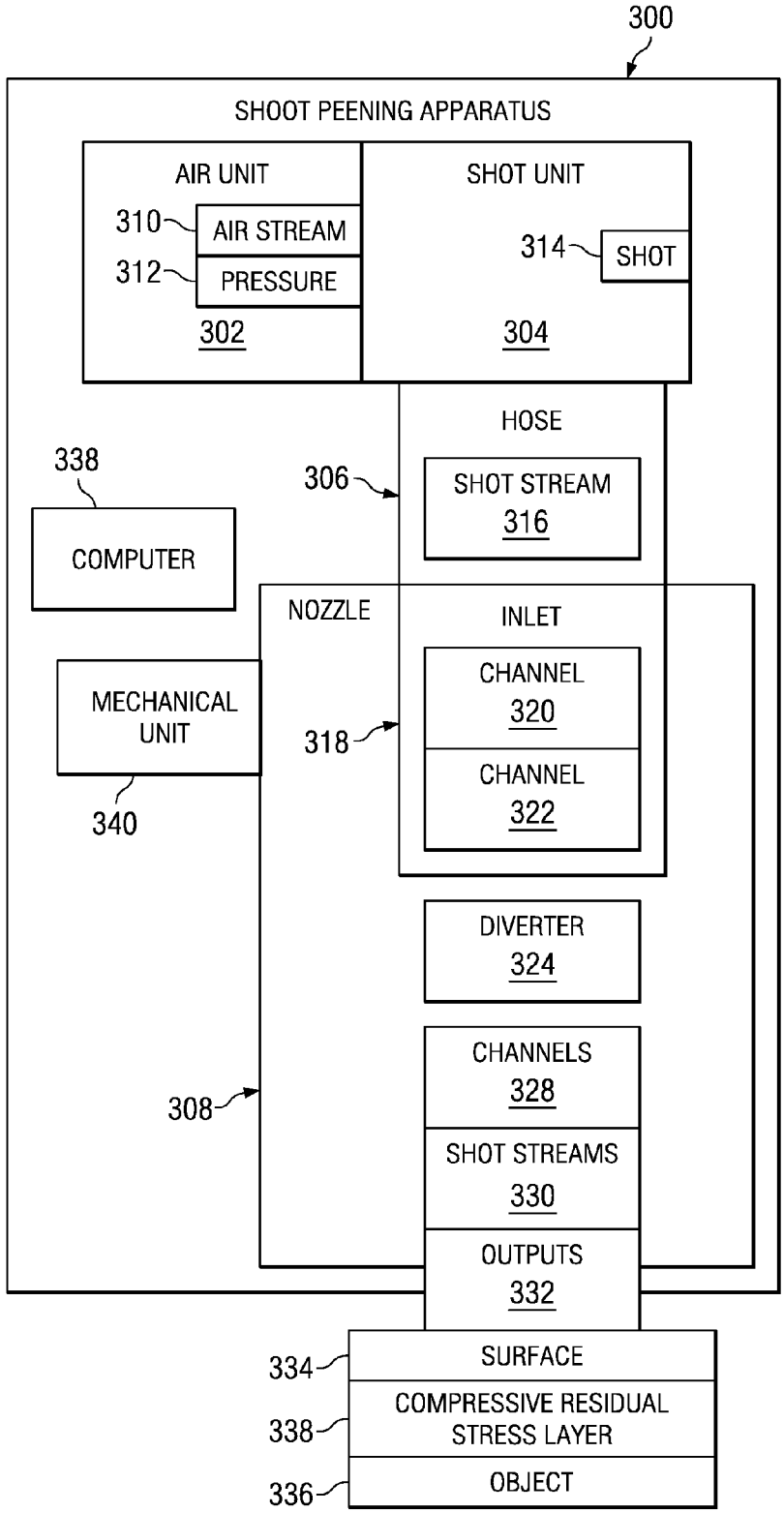
FIG. 3 is a block diagram of a shot peening apparatus in accordance with an advantageous embodiment.

With reference now to FIG. 3, a block diagram of a shot peening apparatus is depicted in accordance with an advantageous embodiment. In this example, shot peening apparatus 300 is an example of an apparatus that may be used to perform a shot peening process.

In this example, shot peening apparatus 300 may include air unit 302, shot unit 304, hose 306, and nozzle 308. Air unit 302 may generate air stream 310, having pressure 312. Air stream 310 may be directed through shot unit 304, in which shot 314 may be added to air stream 310 to form shot stream 316. Shot stream 316 may be a stream of shot carried in air stream 310 in these illustrative examples. In other words, shot may be carried within an air stream to form shot stream 316.

Hose 306 may be connected to inlet 318 of nozzle 308 such that shot stream 316 may be directed into inlet 318. Shot stream 316 may pass through channel 320. In some advantageous embodiments, inlet 318 also may include channel 322. Channel 322 may be smaller in size and/or diameter than channel 320. In other advantageous embodiments, only channel 322 may be present.

Inlet 318 may lead to diverter 324. Diverter 324 may redirect, split, and/or divert shot stream 316 into channels 328. Shot stream 316 may be diverted, split, and/or redirected into shot streams 330 within channels 328. Shot streams 330 may be output through outputs 332 at surface 334. When shot streams 330 impact and/or hit surface 334 of object 336, a plastic deformation may occur around surface 334 of object 336.

This plastic deformation may form compressive residual stress layer 338 within object 336. The residual compressive stress within compressive residual stress layer 338 may confer resistance to dynamic loading and/or some forms of compression. Further, shot streams 330 also may provide a cosmetic effect, in which overlapping dimples may cause light to scatter upon reflection.

Shot 314 may take various forms. For example, without limitation, shot 314 may be comprised from shot made from iron, steel, titanium, aluminum, glass, ceramic, and other suitable materials. Further, shot 314 also may have different shapes and/or sizes depending on the particular implementation.

In these advantageous embodiments, pressure 312 used for shot stream 316 may be at higher pressures than possible with currently used nozzle systems. For example, pressure 312 for shot stream 316 may be around 85 pounds per square inch and still achieve an impact pressure on surface 334 having an Almen intensity of around 0.006 A. With a higher air pressure, additional shot media may be introduced to shot stream 316 and pushed through nozzle 308 to generate the same result more quickly as compared with lower pressures. Further, even with these higher pressures, the intensity of the shot impinging on or striking the surface of an object may be maintained at the desired intensity that may be measured as the Almen intensity. In other words, the higher air pressure may be used to deliver more shot without increasing the intensity as compared to currently used nozzles.

The illustration of shot peening apparatus 300 is presented for purposes of depicting features that may be found in different advantageous embodiments. This illustration in FIG. 3 is not meant to imply physical or architectural limitations to the manner in which different advantageous embodiments may be implemented. For example, in some advantageous embodiments, shot peening apparatus 300 may be a manual system. In other advantageous embodiments, shot peening apparatus 300 may be controlled by computer 338. Computer 338 may control mechanical unit 340 to move and/or direct nozzle 308 to surface 334. Computer 338 also may control air unit 302 to select pressure 312 for air stream 310.

Figure 4:
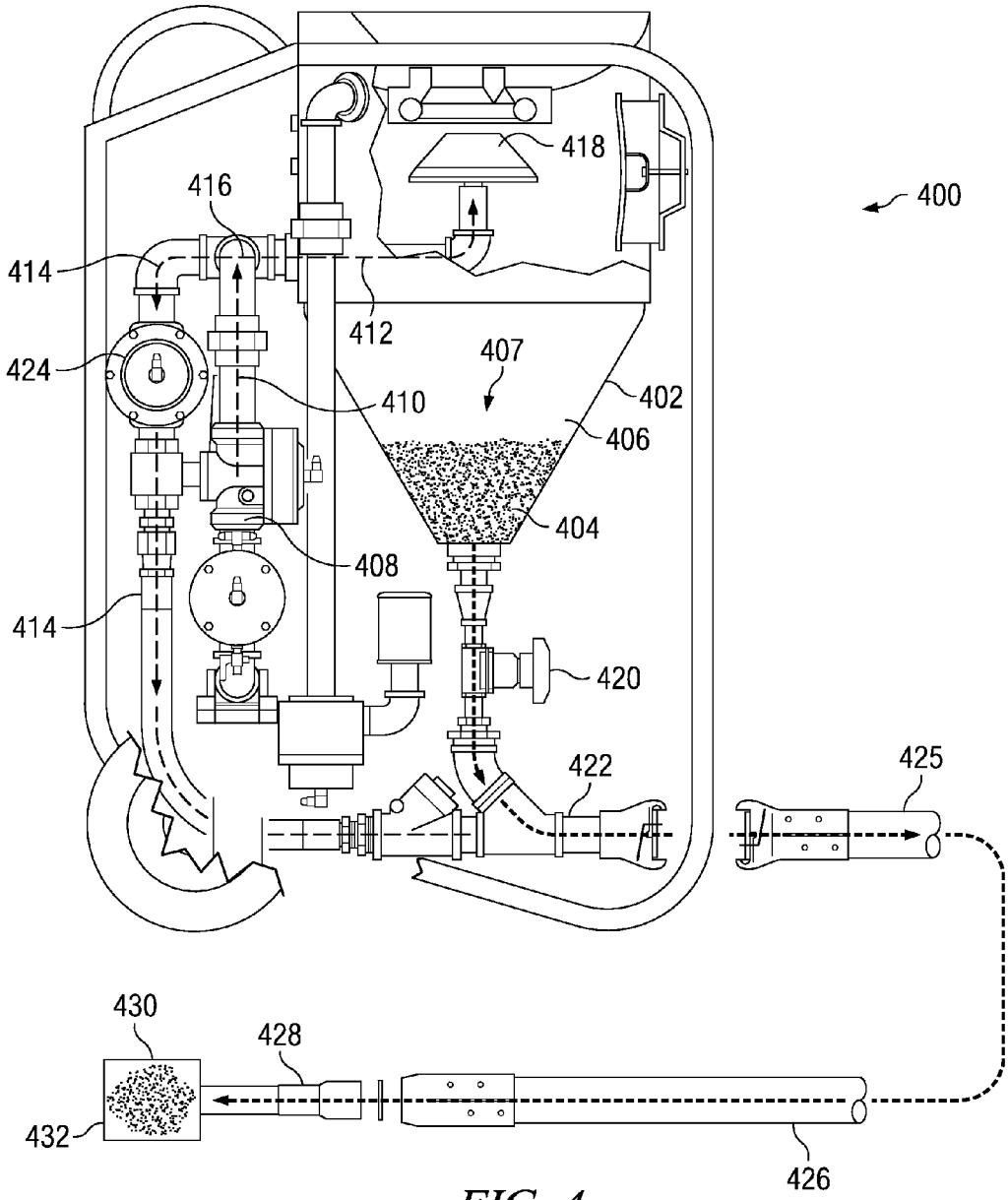
FIG. 4 is a diagram of a shot peening apparatus in accordance with an advantageous embodiment.

With reference now to FIG. 4, a diagram of a shot peening apparatus is depicted in accordance with an advantageous embodiment. In this illustrative example, shot peening apparatus 400 is an example of one implementation for shot peening apparatus 300 in FIG. 3.

Shot unit 402 may receive and hold shot 404 within pressure vessel 406. In this example, pressure vessel 406 is shown with a cutaway to allow viewing of interior 407 of pressure vessel 406. Air 408 may travel along the path indicated 410. Air 408 may travel in the direction of both path 412 and path 414 at joint 416. Air 408 moving in the direction of path 412 may pass through pop-up valve 418. Pop-up valve 418 may rise sealing pressure vessel 406. In this condition, shot 404 may be forced down through metering valve 420 into channel 422.

At the same time that air 408 flows through pop-up valve 418, air 408 also may flow through regulator 424 as indicated along path 414. Air 408 along path 414 may be combined with shot 404 that enters channel 422. Shot 404 and air 408 form stream 425 which passes through tube 426 into nozzle 428.

From this point, stream 425 may pass into nozzle 430. Nozzle 430 may be, for example, without limitation, nozzle 308 in FIG. 3. Stream 425 may be diverted within nozzle 430 and directed as two or more streams of shot at outputs 432 of nozzle 430.

Figure 5:
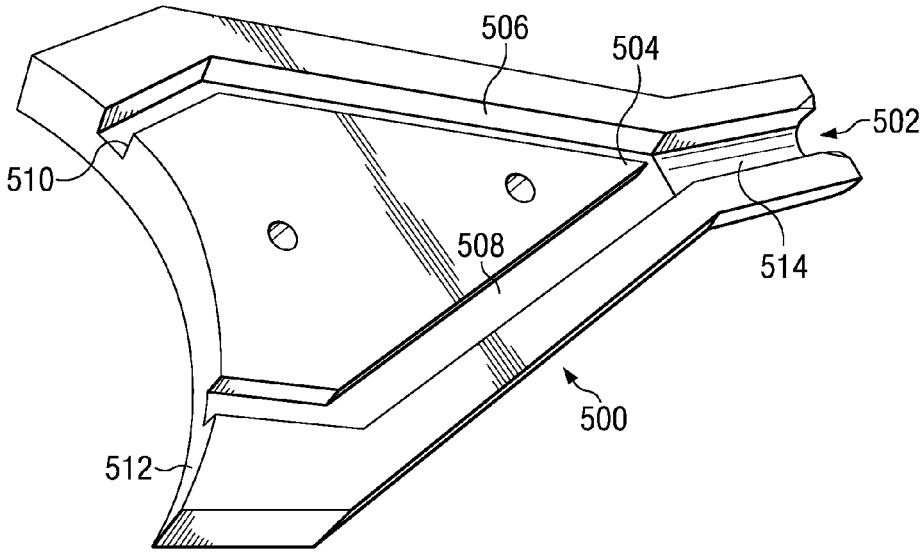
FIG. 5 is a diagram of a cross-sectional view of a nozzle in accordance with an advantageous embodiment.

With reference now to FIG. 5, a diagram of a cross-sectional view of a nozzle is depicted in accordance with an advantageous embodiment. In this example, nozzle 500 is an example of one implementation of nozzle 308 in FIG. 3. Nozzle 500 may include inlet 502, diverter 504, channel 506, channel 508, output 510, and output 512. Inlet 502, in this depicted example, may be comprised of channel 514. Channel 514 may receive a stream of shot which may be diverted by diverter 504 into a plurality of streams in channel 506 and channel 508. These streams may be directed towards an object through output 510 and output 512 at an angle.

Figure 6:
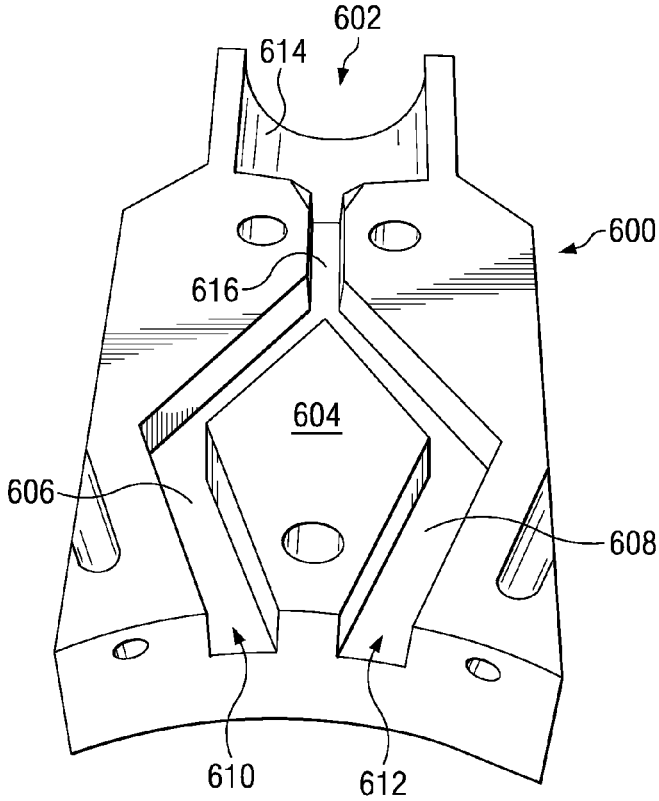
FIG. 6 is another diagram of a cross-sectional view of a nozzle in accordance with an advantageous embodiment.

With reference now to FIG. 6, another diagram of a cross-sectional view of a nozzle is depicted in accordance with an advantageous embodiment. In this example, nozzle 600 is another example of an implementation for nozzle 308 in FIG. 3.

Nozzle 600 may include inlet 602, diverter 604, channel 606, channel 608, output 610, and output 612. In this illustrative example, inlet 602 may include channel 614 and channel 616. Channel 614 may be larger in size than channel 616. In this example, channel 614 may lead and/or connect to another nozzle such as, for example, without limitation, nozzle 430 in FIG. 4. Inlet 602 may receive a stream of shot which may be diverted into two streams in this example, in channels 606 and 608 by diverter 604. The streams may be output from output 610 and output 612.

Figure 7:
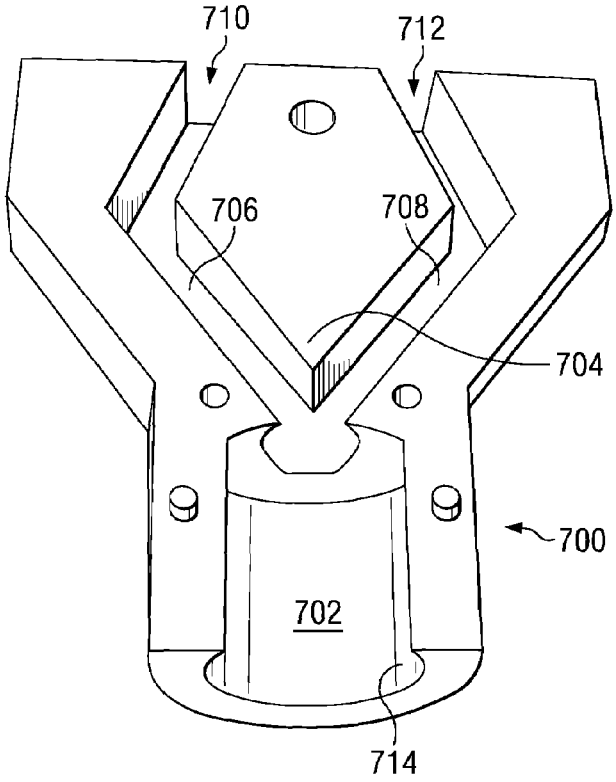
FIG. 7 is a diagram of a cross-sectional view of a nozzle in accordance with an advantageous embodiment.

With reference now to FIG. 7, a diagram of a cross-sectional view of a nozzle is depicted in accordance with an advantageous embodiment. Nozzle 700 is an example of yet another implementation of nozzle 308 in FIG. 3. In this example, nozzle 700 may include inlet 702, diverter 704, channel 706, channel 708, output 710, and output 712.

In this advantageous embodiment, inlet 702 has channel 714, which may receive a nozzle such as, for example, without limitation, nozzle 428 in FIG. 4. Stream of shot may be directed through inlet 702 and split or diverted by diverter 704 into two streams in channel 706 and channel 708. These streams may be directed at an object from output 710 and output 712.

The illustration of the nozzles in FIGS. 5-7 are presented for purposes of depicting a few examples of how nozzle 308 may be implemented. These illustrations are not meant to limit the manner in which other advantageous embodiments may be implemented. For example, without limitation, in other advantageous embodiments, other numbers of channels may be present.

For example, without limitation, three or four or more than four channels may be present instead of two channels as illustrated in these examples. Further, these examples illustrate the channels having a rectangular or square shape. In other advantageous embodiments, the channels may be circular, hexagonal or some other suitable shape.

Figure 8:
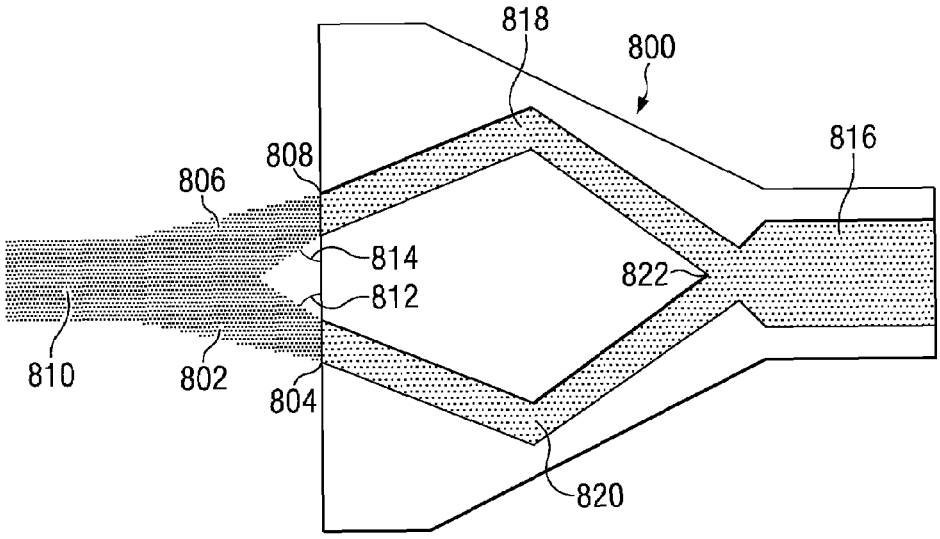
FIG. 8 is a diagram illustrating a spray pattern from a nozzle in accordance with an advantageous embodiment.

With reference now to FIG. 8, a diagram illustrating a spray pattern from a nozzle is depicted in accordance with an advantageous embodiment. In this illustrative example, nozzle 800 may generate stream 802 at output 804 and stream 806 at output 808. These streams may be combined around point 810. As can be seen, stream 802 and stream 806 may be redirected out of output 804 and output 808 at angle 812 and angle 814. Streams 802 and 806 may be generated from streams 818 and 820, streams which in turn may be generated from the splitting or diverting of stream 816 by diverter 822.

Figure 9:
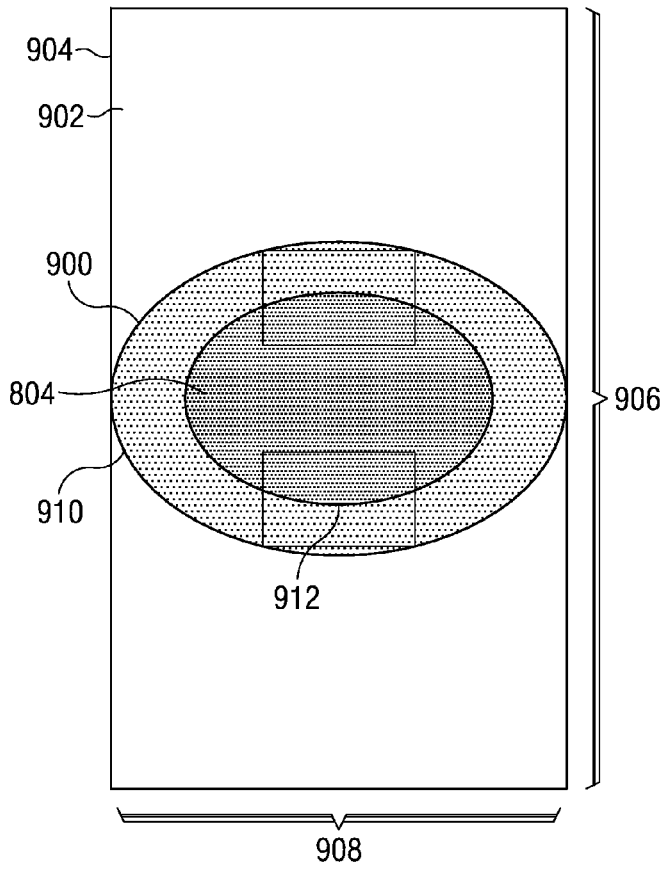
FIG. 9 is a diagram illustrating a spray pattern in accordance with an advantageous embodiment.

With reference now to FIG. 9, a diagram illustrating a spray pattern is depicted in accordance with an advantageous embodiment. In this example, spray pattern 900 is depicted from a front view. Spray pattern 900 may be generated using nozzle 700 in FIG. 7.

Spray pattern 900 may be generated on surface 902 of object 904. In this example, surface 902 has length 906, which may be around 3 inches in length and width 908, which may be around 1.5 inches in width, for example, without limitation.

Spray pattern 900 may have total area 910 with sweet spot 912. In this example, area 910 may be an example of an area that may be peened by the combination of streams 800 and 802 in FIG. 8 around point 804 on surface 902 of object 904.

Figure 10:
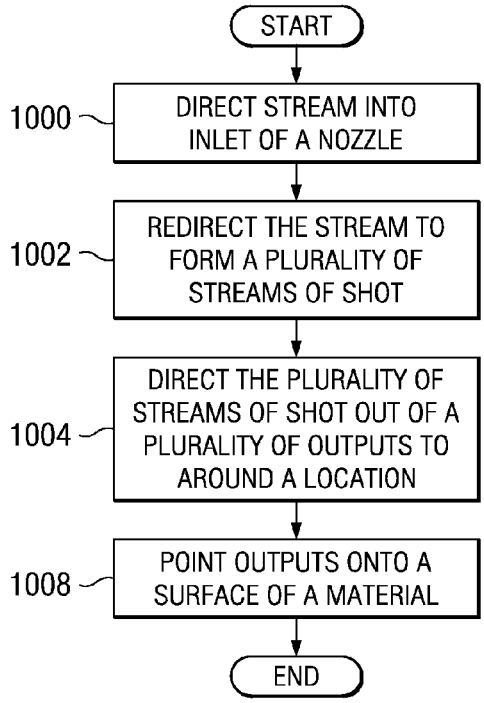
FIG. 10 is a flowchart of a process for sending shot onto a surface of an object in accordance with an advantageous embodiment.

With reference now to FIG. 10, a flowchart of a process for sending shot onto a surface of an object is depicted in accordance with an advantageous embodiment. The process illustrated in FIG. 10 may be implemented using a shot peening apparatus such as, for example, without limitation, shot peening apparatus 300 in FIG. 3.

The process begins by directing stream 810 in FIG. 8 into the inlet 702 of nozzle 700 in FIG. 7 (operation 1000). The process then may redirect stream 808 to form a plurality of streams, streams 802 and 804, within the nozzle (operation 1002). This redirection or splitting of the stream of shot into multiple streams of shot may be performed using a diverter or other mechanism within the nozzle.

The process then directs the plurality of streams of shot out of a plurality of outputs to around a location (operation 1004). The process then points the outputs onto a surface of a material (operation 1006), with the process terminating thereafter.

In these examples, the process in FIG. 10 may be performed manually by an operator directing or moving the nozzle. In other advantageous embodiments, the nozzle may be automatically directed using a computer-controlled mechanism to perform the shot peening on the particular object.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments.

Although the different embodiments are described with respect to shot peening aircraft components, the different advantageous embodiments may be used on other components. These components may include, for example, without limitation, those for ships, spacecraft, trucks, tanks, buildings, power plants, and other suitable objects.

The embodiment or embodiments selected are chosen and described in order to best explain the principles of the embodiments and the practical application, and to enable others of ordinary skill in the art to understand the disclosure for various embodiments with various modifications as are suited to the particular use or uses contemplated.

What is claimed is:

1. A method for sending shot onto a surface, the method comprising:

directing the stream of shot into a first channel in the inlet;

directing the stream of shot into a second channel in the inlet, the second channel being smaller than the first channel;

redirecting the stream of shot to form a plurality of streams of shot within the nozzle; and directing the plurality of streams of shot out of a plurality of outputs of the nozzle.

2. The method of claim 1, wherein directing the plurality of streams of shot comprises:

pointing the plurality of streams of shot to a location.

3. The method of claim 2, wherein pointing the plurality of streams of shot comprises:

pointing the plurality of outputs of the nozzle at a surface of a material, wherein the location is located on the surface of the material.

4. The method of claim 1, wherein redirecting the stream of shot comprises:

dividing the stream of shot into the plurality of streams of shot with a diverter inside the nozzle.

5. The method of claim 1 further comprising:

pointing the plurality of outputs of the nozzle at a surface of a material.

6. The method of claim 1, wherein the stream of shot has a pressure of around 85 pounds per square inch.

7. The method of claim 1, wherein the plurality of streams of shot have a lower air pressure than the stream of shot.

8. The method of claim 1, wherein redirecting the stream of shot to form the plurality of streams of shot within the nozzle comprises deflecting the shot to modulate the intensity of the shot.

9. An apparatus comprising;

a nozzle;

an inlet in the nozzle configured to receiving a stream of shot, the inlet comprising a first channel connected to a second channel, the first channel being larger than the second channel, and the second channel leading to a diverter;

a plurality of channels having a first end connected to the inlet;

the diverter connecting the first end of the plurality of channels to the inlet; and a plurality of outputs located at a second end of the plurality of channels.

10. The apparatus of claim 9, wherein the plurality of channels are configured to redirecting the stream of shot to form a plurality of streams of shot within the nozzle.

11. The apparatus of claim 10, wherein the plurality of outputs are configured to directing the plurality of streams of shot to a location.

12. The apparatus of claim 9 further comprising:

a pressure vessel configured to holding shot; and a hose connecting the nozzle to the pressure vessel.

13. The apparatus of claim 12 further comprising:

an air unit configured to sending a stream of pressurized air through the pressure vessel to form the stream of shot.

14. The apparatus of claim 9, wherein the plurality of channels have a cross section with a shape selected from one of a circle, a square, and a rectangle.

15. The apparatus of claim 9, wherein the plurality of channels are angled channels.

16. The apparatus of claim 9, wherein the plurality of streams of shot have a lower air pressure then the stream of shot.

17. The apparatus of claim 9, wherein the diverter connecting a first end of the plurality of channels to the inlet deflects the shot to modulate the intensity of the shot.

18. A method for shot peening comprising:

directing a stream of shot into an inlet of a nozzle;

directing the stream of shot into a first channel in an inlet of a nozzle;

directing the stream of shot into a second channel in the inlet, the second channel being smaller than the first channel;

redirecting the stream of shot to form a plurality of streams of shot within the nozzle by dividing the stream of shot into the plurality of streams of shot with a diverter inside the nozzle;

directing the plurality of streams of shot out of a plurality of outputs of the nozzle to a location from different angles; and pointing the plurality of outputs of the nozzle at a surface of a material, the location being located around the surface of the material.

19. The method of claim 18, wherein redirecting the stream of shot to form the plurality of streams of shot within the nozzle by dividing the stream of shot into the plurality of streams of shot with a diverter inside the nozzle comprises deflecting the shot to modulate the intensity of the shot.

20. A shot peening apparatus comprising:

a nozzle;

a inlet in the nozzle configured to receiving a stream of shot, the inlet comprising a first channel connected to a second channel, the first channel being larger than the second channel, and the second channel leading to the diverter;

a plurality of channels having a first end connected to the inlet, the plurality of channels being configured to redirecting the stream of shot to form a plurality of streams of shot within the nozzle, and the plurality of channels having a cross section with a shape selected from one of a circle, a square, and a rectangle;

a diverter connecting a first end of the plurality of channels to the inlet;

a plurality of outputs located at a second end of the plurality of channels, the plurality of outputs being configured to direct the plurality of streams of shot to a location from different angles;

a pressure vessel configured to holding shot;

a hose connecting the nozzle to the pressure vessel; and an air unit configured to sending a stream of pressurized air through the pressure vessel to form the stream of shot.

* * * * *